US007950767B2

(12) United States Patent
Murakami et al.

(10) Patent No.: US 7,950,767 B2
(45) Date of Patent: May 31, 2011

(54) IMAGE FORMING APPARATUS

(75) Inventors: Reiji Murakami, Yokohama (JP); Masahiro Ohno, Yokohama (JP); Naofumi Soga, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1133 days.

(21) Appl. No.: 11/678,196

(22) Filed: Feb. 23, 2007

(65) Prior Publication Data

US 2008/0204681 A1 Aug. 28, 2008

(51) Int. Cl.
*B41J 29/393* (2006.01)

(52) U.S. Cl. ..... 347/19; 347/105

(58) Field of Classification Search ..... 347/14, 347/19, 105, 16, 104; 271/3.13, 3.1, 227
See application file for complete search history.

(56) References Cited

U.S. PATENT DOCUMENTS 5,717,977 A 2/1998 Suzuki et al.
2005/0002711 A1 1/2005 Yokoi

FOREIGN PATENT DOCUMENTS

JP 09-113230 5/1997
JP 11-024512 1/1999

OTHER PUBLICATIONS

Chinese Office Action dated Jul. 31, 2009 corresponding to U.S. Appl. No. 11/678,196, filed Feb. 23, 2007.

*Primary Examiner* — Lamson D Nguyen
(74) *Attorney, Agent, or Firm* — Turocy & Watson, LLP

(57) ABSTRACT

An image forming apparatus according to an embodiment of the invention includes: an image generating unit configured to generate an image to be printed on a recording paper; a paper type designating unit configured for a user to directly designate a type of the recording paper or to designate automatic identification of a type of the recording paper; a paper type identification device configured to identify the type of the recording paper presented by the user when automatic identification of the type of the recording paper is designated by the paper type designating unit; and a printing unit configured to print the image generated by the image generating unit onto the recording paper in accordance with the type of the recording paper identified by the paper type identification device.

13 Claims, 7 Drawing Sheets

IMAGE FORMING APPARATUS

BACKGROUND OF THE INVENTION (1) Field of the Invention

The present invention relates to an image forming apparatus and particularly to an image forming apparatus having a paper type identification device.

(2) Description of the Related Art

Traditionally, the number of types of media has increased on which color images are to be printed in an image forming apparatus or the like such as a multifunction color copier (multifunction peripheral or MFP). Even when papers alone are considered as print media, various types of papers that are different in thickness or the like are used.

Such paper types are usually distinguished by grammage ($g/m^2$), which shows the weight per predetermined area. For example, papers within ranges of 64-105, 106-163, 164-209, 210-256, and 257-300 are respectively called plain paper, thick paper 1, thick paper 2, thick paper 3, and thick paper 4. The grammage depends on the density and thickness of paper, but if the density of paper is constant, they will be proportionate to the thickness.

If the paper type, that is, the thickness and density of paper differs in this manner, optimum printing conditions to acquire a satisfactory print image differ. Generally, as the thickness of paper increases, the fixing temperature of an image that has been made visible falls quickly. If the image is fixed at the same temperature, a fixation defect, or wait and stop due to the lowering of the temperature occurs, and a satisfactory print image cannot be acquired. Thus, to acquire a satisfactory print image, it is necessary to distinguish a paper for printing.

Traditionally, such identification of a paper type is carried out as a user inputs the thickness and grammage on a screen displayed on a control panel of the multifunction peripheral. In accordance with the inputted thickness and grammage of the paper, fixation of a visible image, the speed of carrying the paper and the like are controlled.

However, except for the case where recording papers are set in a recording paper housing cassette, the user rarely knows the thickness of the papers or the like very well. Therefore, the paper type is erroneously set, a satisfactory print image cannot be acquired, and recording papers are often wasted.

Thus, an image multifunction peripheral is known in which the thickness or the like of papers housed in a recording paper housing cassette is automatically detected and in which, for a thick recording paper, a separately provided fixing auxiliary power source is driven to perform satisfactory printing (see JP-A-11-24512).

However, in the apparatus in which the thickness of paper is detected by a medium sensor, the thickness of a recording paper is detected when the recording paper is pulled out from the recording paper housing cassette as described above. Therefore, there is a problem that a sufficient time cannot be taken before an image is actually printed and therefore a satisfactory print image cannot be acquired, or that if a sufficient time is taken before printing, the overall printing time becomes longer.

A light emission quantity adjustment apparatus is also known in which the thickness of a medium is detected and the quantity of light emission of a light-transmitting sensor arranged within the apparatus is adjusted (JP-A-9-113230).

BRIEF SUMMARY OF THE INVENTION

The present invention has been made in view of the traditional problems as described above and it provides an image forming apparatus that enables accurate determination of paper type and satisfactory printing without increasing the overall printing time, and a paper type identification method in the image forming apparatus.

According to an aspect of the invention, there is provided an image forming apparatus including: an image generating unit configured to generate an image to be printed on a recording paper; a paper type designating unit configured for a user to directly designate a type of the recording paper or to designate automatic identification of a type of the recording paper; a paper type identification device configured to identify the type of the recording paper presented by the user when automatic identification of the type of the recording paper is designated by the paper type designating unit; and a printing unit configured to print the image generated by the image generating unit onto the recording paper in accordance with the type of the recording paper identified by the paper type identification device.

DETAILED DESCRIPTION OF THE INVENTION

Hereinafter, an embodiment of an image forming apparatus according to the invention will be described with reference to the drawings. In the following, description is made on the assumption that the image forming apparatus of the embodiment is a multifunction color copier.

Figure 1:
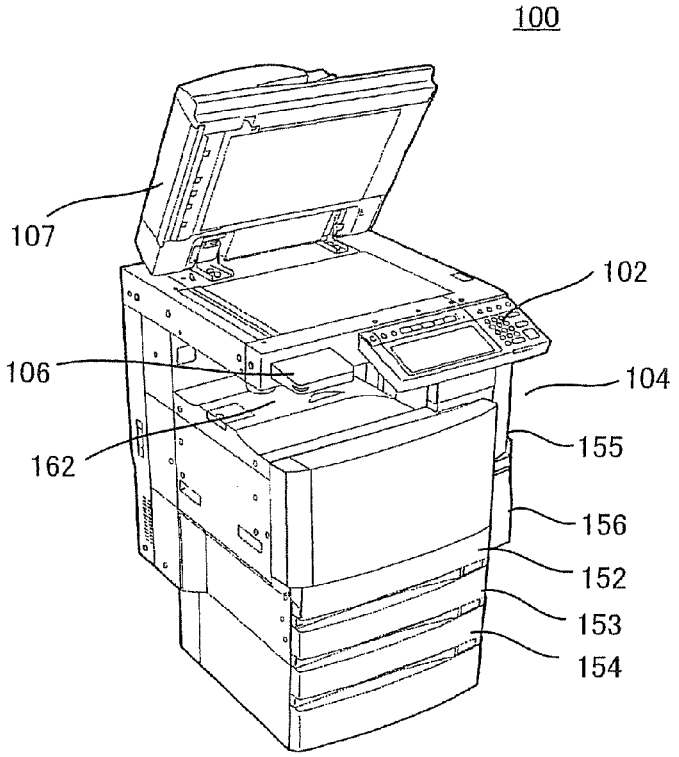
FIG. 1 is a perspective view showing the schematic appearance of a multifunction color copier according to an embodiment of the invention.

FIG. 1 is a perspective view showing an exemplary appearance of the multifunction copier according to this embodiment of the invention.

At the top of an apparatus body 100, an automatic document feeder (ADF) 107 that also serves as an original cover and automatically feeds sheet-like originals one by one, is provided to be openable and closable. At a front part on the upper side of the apparatus body 100, an operation panel 102 is provided which has various operation keys and various display units and the like for instructing copy conditions and the start of copy.

Below the operation panel 102 on the front side of the apparatus body 100, a handle 104 is provided so that the inside of the body can be opened when paper jam or the like has occurred. On the front side of the apparatus body 100, a paper type identification device 106, which will be described later in detail, is provided parallel to the operation panel 102. Therefore, it is easy to use the paper type identification device 106 while confirming the display of the operation panel 102.

In the lower part of the apparatus body 100, paper feed cassettes 152, 153 and 154 are provided in an attachable and removable manner. In each of these paper feed cassettes 152, 153 and 154, papers of the same size are housed laterally or longitudinally. When printing is carried out, the papers are selected and fed.

On the right side of the apparatus body 100, an automatic double-side unit 155 for carrying out double-side copy, and a manual insertion tray 156 that can be folded when not used and that is adapted for manually inserting and supplying papers, are provided in an attachable and removable manner. A paper discharge tray 162 that receives printed papers is provided in the apparatus body 100.

On the rear side of the apparatus body 100, terminals of a parallel port, a serial port, SCSI and the like are provided, not shown. The parallel port is to connect this apparatus with an external device such as a personal computer (PC) when this apparatus is caused to operate as a printer.

The serial port is to connect this apparatus with an external device such as PC in order to read out internal management information of the apparatus and setting functions of the apparatus at the time of maintenance of the apparatus.

The SCSI is to communicate commands and data between this apparatus and an external controller that operates as a master.

Figure 2:
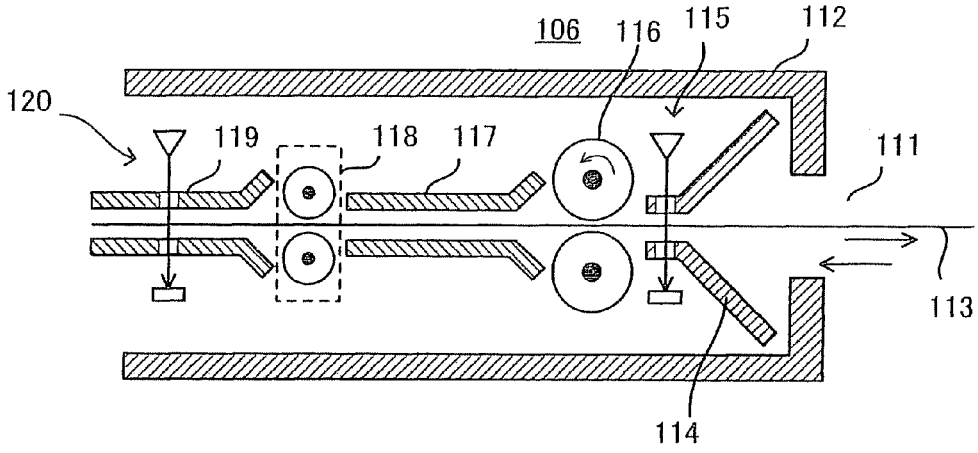
FIG. 2 is a sectional view showing the structure of a paper type identification device according to an embodiment of the invention.

Here, the structure and control system of the paper type identification device 106 will be described with reference to FIG. 2 and FIG. 3. FIG. 2 is a sectional view showing the structure of the paper type identification device 106.

The paper type identification device 106 has a casing 112 having a recording paper insertion port 111 on its front side, an insertion guide 114 that nips an inserted recording paper 113 from above and below and guides it, an insertion detection sensor 115 that is provided at a part of the insertion guide and detects insertion of the recording paper, pull-in ejection rollers 116 that nip the recording paper 113 detected by the insertion detection sensor 115, from above and below, and rotate forward to further pull the recording paper in, a center guide 117 that guides the recording paper 113 pulled in by the pull-in ejection rollers 116, a paper type identification sensor 118 that nips the recording paper 113 guided by the center guide and later identifies the paper type, an edge guide 119 that guides the paper type identification sensor 118 further into the depth, and an edge detection sensor 120 that is provided at a part of the edge guide 119 and detects the edge of the recording paper 113.

Specifically, the insertion detection sensor 115 and the edge detection sensor 120 are formed by, for example, a light emitting diode and a light receiver that receives light from the light emitting diode. The paper type identification sensor 118 is formed by, for example, a pair of rollers, and identifies the paper type in accordance with the thickness of the inserted recording paper. The pull-in ejection rollers 116 are driven to rotate backward and eject the recording paper 113 after the paper type of the recording paper 113 is identified.

Figure 3:
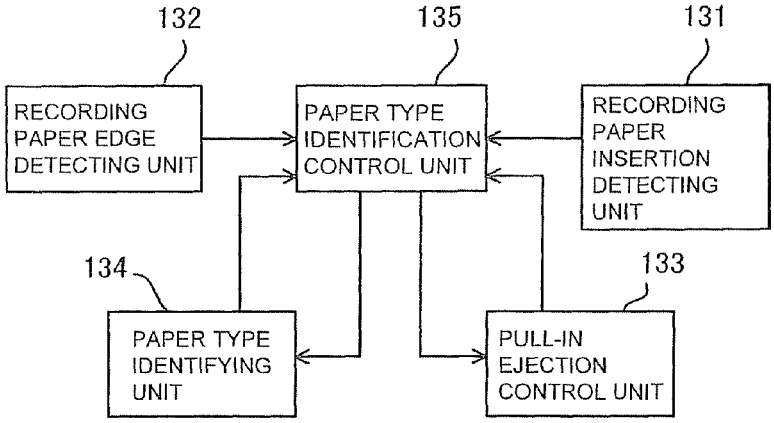
FIG. 3 is a block diagram showing the electric configuration of the paper type identification device shown in FIG. 2.

FIG. 3 is a block diagram of a control circuit of this paper type identification device 106. This control circuit has a recording paper insertion detecting unit 131 that is connected to the insertion detection sensor 115 and detects insertion of the recording paper when it is inserted, a recording paper edge detecting unit 132 that is connected to the edge detection sensor 120 and detects the edge of the recording paper, a pull-in ejection control unit 133 that changes the direction of rotation and thereby performs driving control of the direction of rotation, that is, forward or backward, of the pull-in ejection rollers which pull in and eject the recording paper, a paper type identifying unit 134 that is connected to the paper type identification sensor 118 and identifies the paper type of the recording paper 113, and a paper type identification control unit 135 that controls each of these units of the paper type identification device.

As the paper type identifying unit 134, a distance measuring sensor can be used that measures the paper thickness from the distance of vertical movement of a pair of rollers, as shown in the drawing, and thus identifies the paper type.

For this distance measuring sensor, for example, a sensor described in "8-bit accuracy distance measuring sensor", Sensor Technology, October 1992, Vol. 12, No. 11, pages 24-27, is used. This distance measuring sensor is called, for example, position sensitive detector. It casts light from a light emitting element to a measuring object and measures the distance based on the incident position on the sensor of reflected light from the measuring object.

Also, as a method of using the distance measuring sensor of this type to measure the distance of vertical movement of the rollers and thus detecting the paper thickness, the quantity of displacement of at least one of a pair of rollers that is nipping the recording paper is detected.

For example, it is possible to detect the paper thickness by detecting the output of a light receiving unit of a micro displacement sensor as shown by Japanese Patent 3728244.

The paper type identifying unit 134 may include a light emitting unit and a light receiving unit that receives light radiated from this light emitting unit, and may identify the paper type in accordance with the light transmittance of the recording paper.

Figure 4:
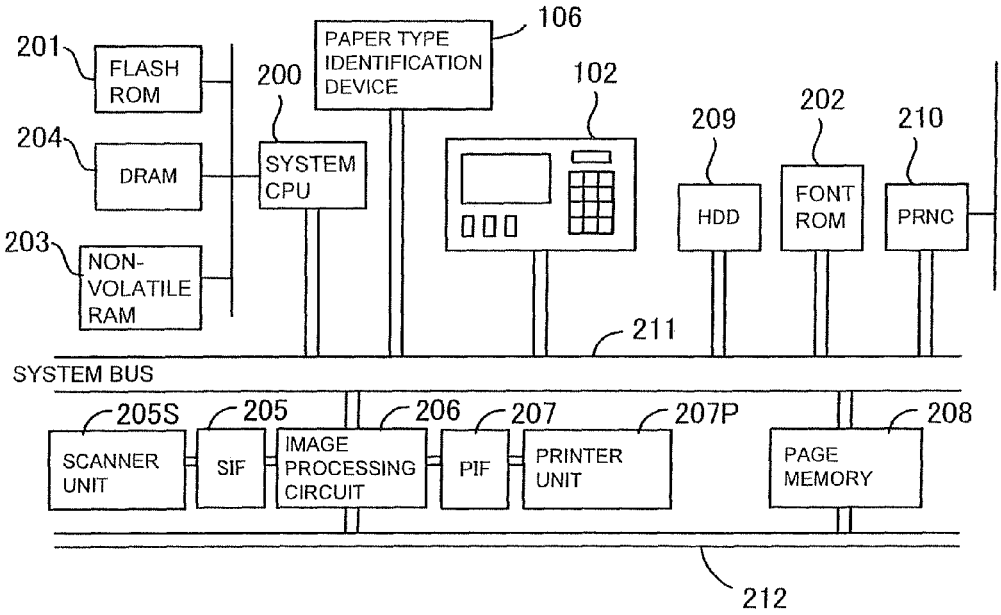
FIG. 4 is a block diagram showing the overall configuration of an embodiment shown in FIG. 1.

FIG. 4 is a block diagram showing the configuration of a control system of the multifunction color copier according to this embodiment.

This apparatus has a system CPU 200, a flash ROM 201 for storing programs and fixed data, a font ROM 202 for converting text data to font data, and a non-volatile RAM (NVRAM) 203 and DRAM 204 for work and data storage.

The system CPU 200 controls the entire apparatus. Here, it controls each function in accordance with an instruction signal made by the user from the operation panel 102, a signal input from a communication line, and input signals from various external interfaces.

A scanner interface (SIF) 205 receives image data from a scanner unit 205S. An image processing circuit 206 performs image editing processing such as high image quality processing according to a recording medium, enlargement and reduction processing, pixel thinning processing, and transposition processing of a designated area based on marker detection.

A printer interface (PIF) 207 supplies image data to a printer unit 207P. A page memory 208 stores, page by page, image data that has been processed by the image processing circuit 206 and in a standby state for output. The page memory has the function of page buffer to temporarily store the image data and also includes a codec that carries out compression and expansion.

Control signals between the system CPU 200 and the devices including the paper type identification device 106 are communicated at a high speed by a system bus 211. Meanwhile, each device for processing image signals is connected via an image bus 212.

The image bus 212 is a unique bus provided for the apparatus to operate as a copy machine. To guarantee real-time operation of the copy machine, the operations of receiving image data inputted from the scanner unit 205S by the scanner interface 205, performing various editing processing such as high image quality processing and enlargement and reduction processing by the image processing circuit 206, and outputting to the printer unit 207P by the printer interface 207 are carried out in parallel. Here, this processing is called basic copy.

Of the boards connected to the image bus 212, a processing board that is unnecessary for the operation at the time is in a transit state.

A large-capacity memory device, for example, hard disk driving circuit (HDD) 209, stores image data provided from an external device, and image data or the like for printing of plural copies, acquired by the scanner unit 205S.

A printer network controller (PRNC) 210 has an interface with the printer unit 207P that controls an image forming function at the time of the copy operation or printer operation. At the same time, it is connected to a LAN via a built-in device such as a network interface card. The printer network controller performs protocol control, and data transfer, compression or expansion control, in order to receive print data via the LAN from an external device such as a personal computer, buffers the data, and transfers the data to the printer unit 207P.

Figure 5:
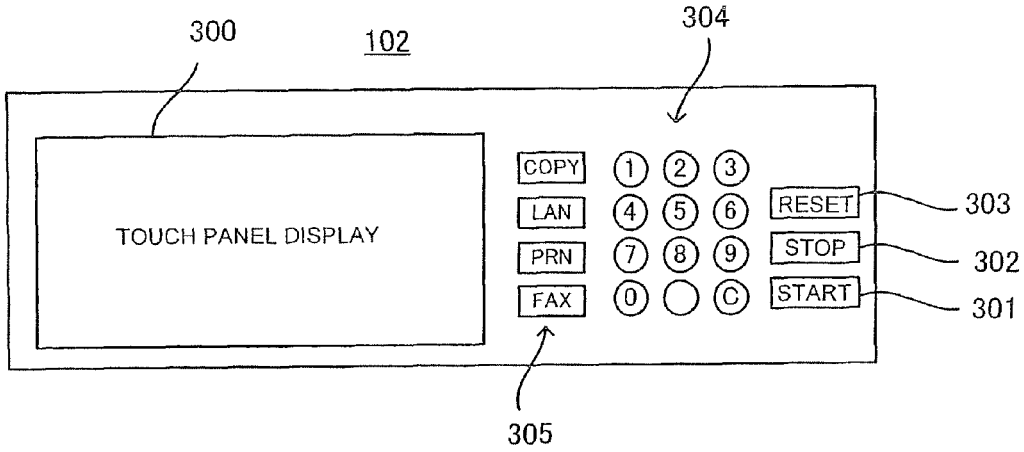
FIG. 5 is a plan view of an operation panel 102 in this embodiment.

FIG. 5 is a view showing an exemplary configuration of the operation panel 102. In the operation panel 102, a touch panel display 300 is provided on the left, and a start key 301, a stop key 302, a reset key 303, a ten-key pad 304 for setting numerals, function mode selection keys 305 that enable selection of a function mode such as copy or facsimile, and the like are provided on the right. A print mode is a mode used in the case of printing with an external personal computer or the like connected.

The ten-key pad 304 has a layout similar to the ten-key arrangement of a button telephone or the like so that it can be shared in copy, facsimile, and print.

Figure 6:
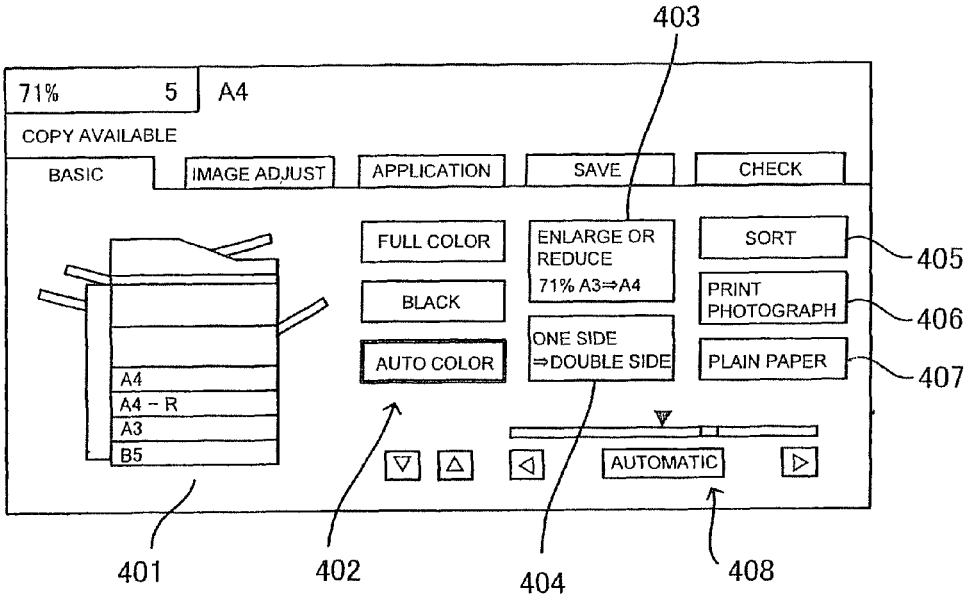
FIG. 6 is a view showing a display screen of a touch panel display 300 of the operation panel 102 shown in FIG. 5.

On the touch panel display 300, for example, a touch panel guidance screen as shown in FIG. 6 is displayed. There are five modes of basic, image adjustment, application, save, and check. One of these modes can be selected when the corresponding tab that is displayed is touched.

In the basic mode, as shown in FIG. 6, a body side icon 401 showing a side view of this apparatus body is displayed on the left, and a color or monochrome icon 402 is shown on the right, by which one of color, black, and auto is selected for the print image. Further to the right of these icons, there are displayed a copy magnification icon 403, a one-side or double-side icon 404, a sort icon 405, an image type icon 406, a paper type icon 407 indicating the type of the recording paper, and a density icon 408 that graphically shows the density below these icons so that the density can be selected.

As for the copy magnification icon 403, the one-side or double-side icon 404, the sort icon 405, and the image type icon 406, a selection display screen is displayed in which one of these plural types can be selected by touching. As the user touches one of them on the selection display screen with a finger, the display screen shown in FIG. 6 returns and the selected choice is displayed on the icon.

For example, the user touches the one-side or double-side icon 403 and selects whether the original is one-sided or double-sided, or whether printing is one-sided or double-sided. For example, if the user selects printing a double-side printed original to one side, the one-side or double-side icon 404 shown in FIG. 6 shows "double side→one side".

Figure 7:
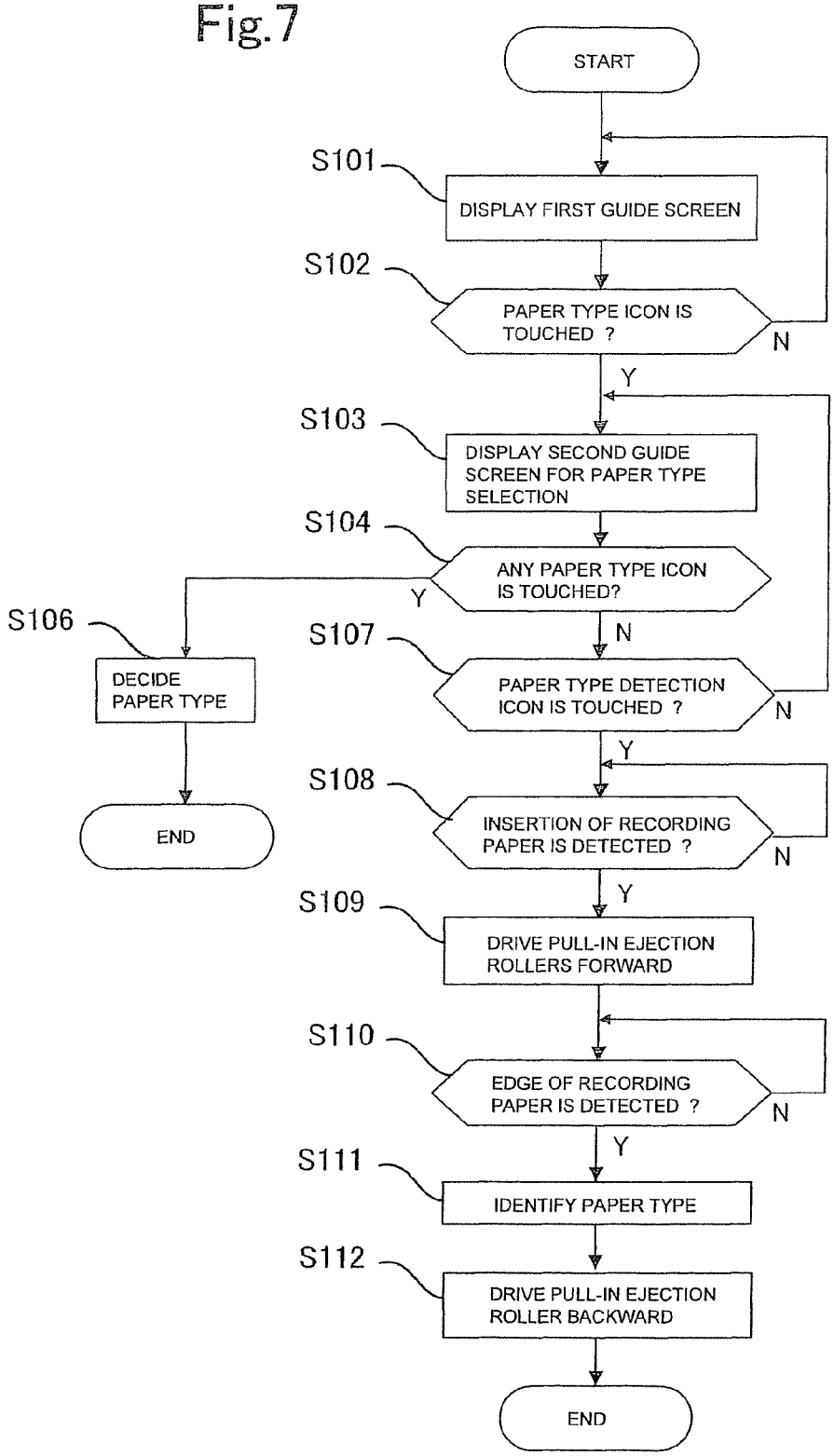
FIG. 7 is a view for explaining the operation of the paper type identification device 106 in this embodiment.

In the initial state, printing is made on the assumption that the recording paper is a plain paper, and the paper type icon 407 shows plain paper. Now, the operation of the paper type identification device 106 in the case where the recording paper 113 is inserted by the user, will be described with reference to FIG. 7.

In step S101, a touch panel guidance screen as shown in FIG. 6 is displayed. In the next step S102, it is detected whether the paper type should be changed or not, in accordance with whether the user has touched the paper type icon 407 or not.

Figure 8:
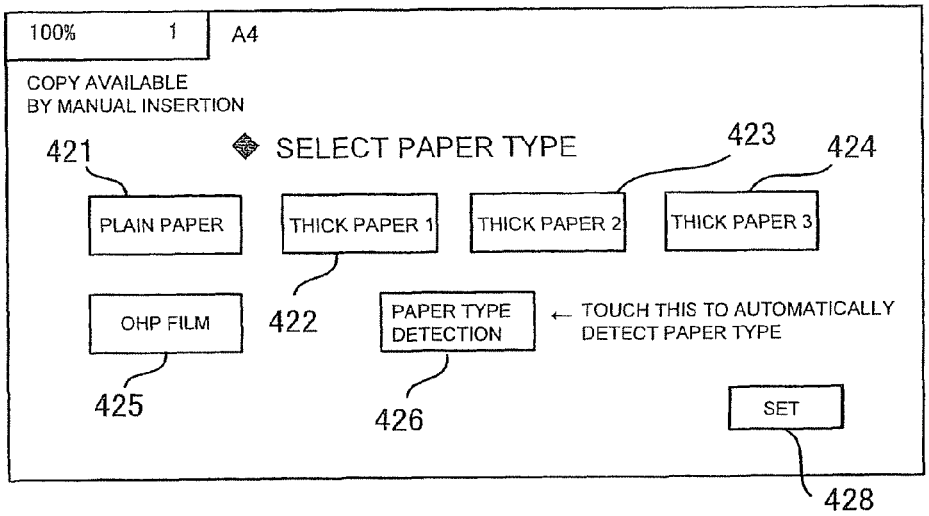
FIG. 8 is a view showing a display screen of the touch panel display 300 when changing the setting of the paper type.

When the paper type icon 407 has been touched, in step S103, for example, a paper type detection guidance screen on which paper type icons are arrayed as shown in FIG. 8 is displayed (step S103).

In this case, icons 421, 422, 423, 424, and 425 indicating plain paper, thick paper 1, thick paper 2, thick paper 3, and OHP, and an icon 426 showing paper type detection are displayed. Above these, "Select paper type" is shown. To the side of the paper type detection icon 426, "Touch this to automatically detect paper type" is shown.

In the case where the user knows the paper type from the grammage or the like, the user can directly touch the icons 421 to 425 to select the paper type. After this, the user can touch a setting icon 428 displayed at a lower right part of the display screen to set the paper type.

In step S104, it is detected whether the user has touched other icons than the paper type detection icon 426 or not. If the user has touched the setting icon 428 after touching one of these icons, the processing shifts to step S106 and the paper type is decided. The screen returns to the touch panel guidance screen of FIG. 6.

Figure 9:
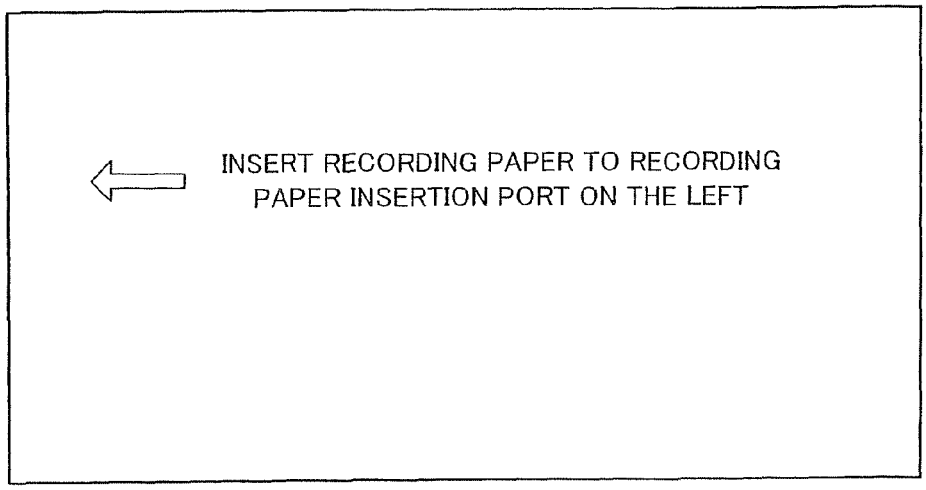
FIG. 9 is a view showing a display screen of the touch panel display 300 when detecting the paper type.

On the other hand, in the case where the user does not know the paper type, the user touches the paper type detection icon 426. This is detected in step S107 and a screen of FIG. 9 is displayed. On the screen shown in FIG. 9, "Insert recording paper to recording paper insertion port on the left" is shown together with a leftward arrow. The paper type identification de vice 106 is provided on the left side as viewed from the user's position, as shown in FIG. 1, and the user can easily find the recording paper insertion port 111.

As the insertion detection sensor 115 detects in step S108 that the recording paper 113 has been inserted in the recording paper insertion port 111 of the paper type identification device 106, the pull-in ejection control unit rotationally drives the pull-in ejection rollers 116 forward. Then, the recording paper 113 is pulled deeper into the paper type identification device 106.

Figure 10:
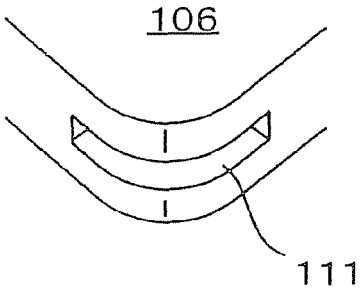
FIG. 10 shows a state of a recording paper insertion port 111 in the paper type identification device 106 according to an embodiment of the invention.
Figure 11:
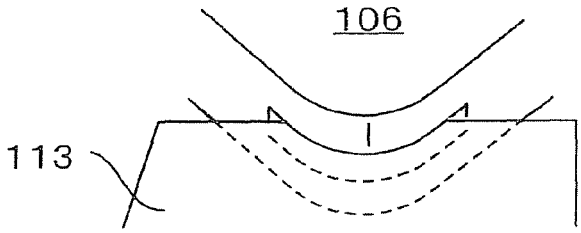
FIG. 11 is a view showing a state where a recording paper 113 is inserted into the recording paper insertion port 111 shown in FIG. 10.

FIG. 10 shows the recording paper insertion port 111 of the paper type identification device 106. FIG. 11 shows a state where the recording paper 113 on which paper type identification is to be made is inserted in this recording paper insertion port 111.

When the edge of the recording paper is detected by the edge detection sensor 120 in the next step S110, a detection signal is sent from the recording paper edge detecting unit 132 to the paper type identification control unit 135, and a control signal to command identification of the paper type is sent to the paper type identifying unit 134. In the next step S111, the paper type is identified by the paper type identification sensor 118. As this identification of the paper type is completed, a paper type identification completion signal is sent from the paper type identifying unit 134 to the paper type identification control unit 135.

The paper type identification control unit 135 sends a control signal to the pull-in ejection control unit 133. The pull-in ejection control unit 133 rotates the pull-in ejection rollers 116 backward. This causes the recording paper 113 to be ejected from the paper type identification device 106.

In this manner, automatic detection of paper type is carried out by the paper type identification device 106, and the paper type that has been automatically detected is displayed in the paper type icon 407 on the touch panel guidance screen shown in FIG. 6.

The body side icon 401 displays the overall status of the apparatus body, and it is used, for example, to show the paper cassette in which there are papers, the location of failure, and so on.

Also, at an upper left part of the touch panel display 300, for example, the enlargement and reduction magnification, the number of copy sheets and the size of paper that are currently set, are displayed.

For example, when five copies are to be made, the function mode selection key 305 is switched to copy and the one-side or double-side icon 404 is touched. Thus, desired processing such as double-side copy is selected, and after that, the key of "5" of the ten-key pad 304 is pressed.

Then, this number is displayed in an upper right area of the touch panel display 300. After confirming this, the user sets an original and presses the start key 301. Thus, the copy operation starts and five copies are made.

Figure 12:
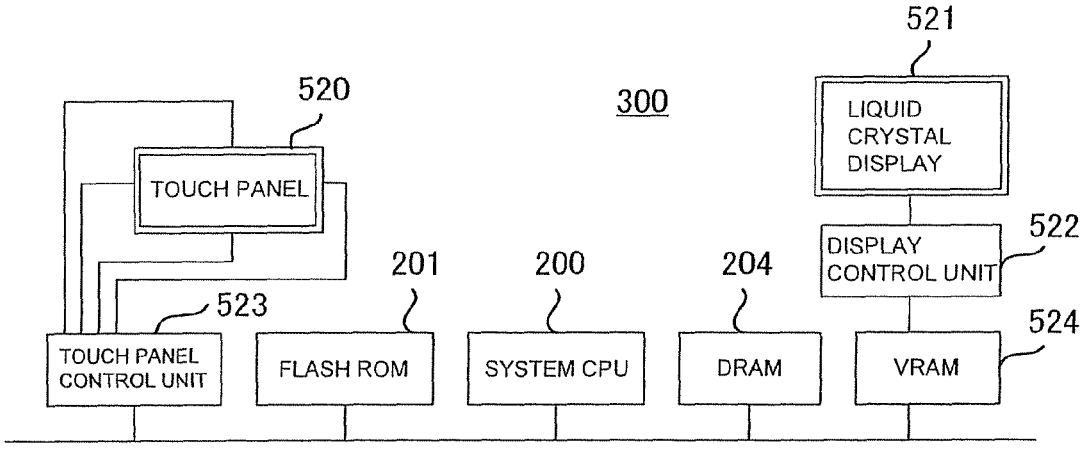
FIG. 12 is a block diagram showing the electric configuration of the touch panel display 300.

FIG. 12 is a block diagram showing the electric configuration of the above touch panel display 300.

The touch panel display 300 is formed by a liquid crystal display panel 521 and a touch panel 520 superimposed thereon. In the touch panel 520, a transparent resistor is uniformly applied on a transparent board and transparent electrode groups are arranged in parallel at predetermined spacing in X and Y directions.

Under the control of a touch panel control unit 523, a voltage is sequentially applied in a predetermined direction to each transparent electrode in the X and Y directions in the touch panel 520. A position instruction operation to the touch panel 520 is carried out with a dedicated conductive pen or a finger.

The touch panel control unit 523 monitors the resistance value between the respective electrodes in the X and Y directions, and detects the position where the resistance value is locally reduced by an instruction with the conductive pen or finger on the basis of calculation with the resistance value between the respective electrodes.

Also, to the liquid crystal display 521, a display control unit 522 for driving this for display is connected. A video RAM (VRAM) 524 that stores display data by display pixel is connected to the display control unit 522.

In the touch panel display 300 of the above configuration, position data acquired by the touch panel control unit 523 is read by the system CPU 200 (see FIG. 4) in the main control unit and processing corresponding to this position data is executed by the system CPU 200. This touch panel display 300 can be used for a wide variety of purposes, for example, in the case of making a hand-writing input, data on the video RAM 524 corresponding to the position indicated on the touch panel 520 is inverted to a display state from a non-display state, and an operation parameter is inputted by selection from a keyboard display or various setting button groups displayed on the liquid crystal display 521.

Figure 13:
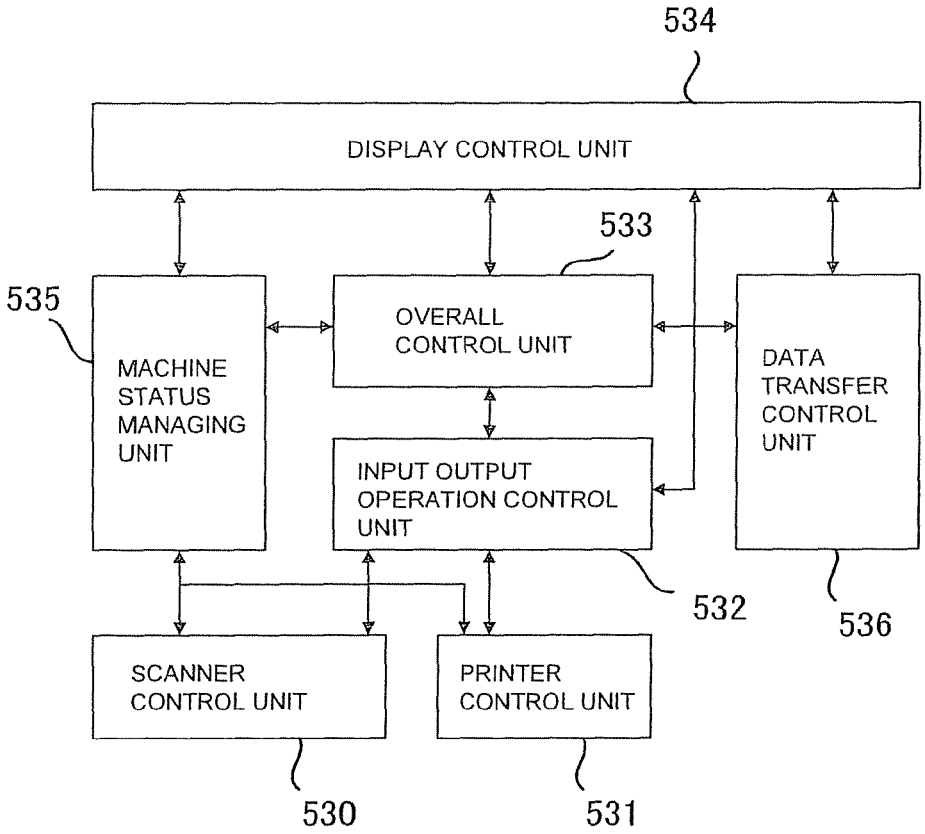
FIG. 13 is a block diagram showing the overall electric configuration of this embodiment.

FIG. 13 is a block diagram showing the functional configuration of the control unit in the multifunction color copier according to this embodiment. This control unit is equivalent to control units of the respective components such as the programs and fixed data stored in the flash ROM 201 shown in FIG. 4, the system CPU 200 that executes these, and the touch panel control unit 523. Functionally this control unit can be shown in FIG. 13.

A scanner control unit 530 is equivalent to scanner control firmware that performs scanner control ASIC, scanner driving control at the time of image input, ADF control and the like, and an image processing unit for preprocessing that performs shading correction and the like. It is carried on the scanner unit 205S shown in FIG. 4.

A printer control unit 531 is equivalent to printer operation control firmware that performs printer control ASIC, output-side image processing ASIC, printer control at the time of printing, paper carrying control and the like, and printer-side image processing firmware, which are installed in the printer unit 207P.

Also, the printer control unit 531 has an interface with a printer driver such as a personal computer, and carries out command communication of control commands, status and the like, and print data communication control. It also carries out execution control of both print output of image data inputted from the scanner unit 205S and image data output transmitted from the printer driver.

Each of the scanner control unit 530 and the printer control unit 531 has a control CPU and realizes high-speed control. These control units carry out command and status communication with the system CPU 200 shown in FIG. 4, control synchronous operations of the display, scanner and printer, and realize a copy operation and print output operation of the apparatus as a whole.

An input output operation control unit 532 includes an image processing unit and also has interfaces with the scanner control unit 530 and the printer control unit 531. Triggered by an operation start command received from an overall control unit 533, the input output operation control unit performs driving timing control of the scanner unit 205S and the printer unit 207P. At the same time, it calculates an image processing parameter and makes setting to the image processing circuit 206, thus controlling the copy function.

Timing control means, for example, designation of ADF driving timing, scanner driving timing, modification processing for an image spread in a memory, print start timing, input start timing for the next original, and the like. Also, the printer control unit 531 is notified of a secure and release command related to printer resources received from a display control unit 534, and so on.

The display control unit 534 is formed by display control software to control the operation panel 102 of the apparatus described above with reference to FIG. 5 and FIG. 6. Here, the display control unit communicates operation information of the operation panel 102 to the overall control unit 533, and it also receives various status changes that have occurred in the apparatus as information from a machine status managing unit 535 and reflects them on the display. Also, the display control unit receives information related to the processing results and proceedings such as the result of copying, the number of copies and size information in copying, from the overall control unit 533, and reflects them on the display. This reflection technique specifically refers to turning on the LED on the operation panel 102 or displaying a message on the liquid crystal display 521.

Moreover, the overall control unit 533 constantly monitors the overall operation status of the apparatus and carries out exclusive control of resources shared by plural functions such as the scanner unit 205S and the printer unit 207P, copying, priority operation in printing print data, screen unit switching operation and the like. For example, in the case where the copy screen is being operated, or in the case where copying is to be made preferentially executable, printing of print data is inhibited for a predetermined period, or conversely, when printing of print data starts, the screen is switched to a display showing that printing is being carried out and execution of copying is limited. Also, the overall control unit performs time control such as timer monitoring, and properly carries out menu switching control on the display control unit 534 in accordance with the status.

The machine status managing unit 535 monitors status of the machine that is notified of by the scanner control unit 530 and the printer control unit 531, specifically, information such as paper jam, jam cancellation, and opening and closing of the front cover, and notifies the overall control unit 533 and the display control unit 534 of the information. Thus, an error status is reflected in the display or reflected in the determination of whether a copy operation is executable or not.

Also, a machine recovery operation at the time of error cancellation or at end of a job is managed in accordance with an instruction from the overall control unit 533. The recovery operation in this case means a preparation operation for the next copying, such as initialization of the indicator position of the scanner unit 205S and warm-up operation of a heat roller unit.

A data transfer control unit 536 has a data transfer function between external devices. This data transfer control unit 536 includes the printer network controller (PRNC) 210 in FIG. 4 and is also equivalent to communication control software for control signals and image data to and from a scanner, printer or digital copier connected via a LAN. The printer network controller 210 includes a network interface card (NIC) and a buffer memory or the like.

In this multifunction color copier, the user selects a function by pressing one of the function mode selection keys 305 on the operation panel 102 shown in FIG. 5. The paper type icon 407 is as described above.

When the user wants to, for example, make a copy, the user presses the copy key and enters the number of copies on the ten-key pad 304. At that time, the user watches the setting shown on the first guide screen displayed on the touch panel display 300. If the user wants to change the setting, the user touches a corresponding icon with a finger and changes the setting. In the setting where there are three or more choices, the choices are displayed on the second guide screen that appears subsequently. For example, when the copy magnification icon 403 is touched, the current magnification, an up-key and a down-key are displayed on the second guide screen. The magnification can be increased as the up-key is touched. The magnification can be decreased as the down-key is touched. When it is finished, a "Back" icon (not shown) may be touched and the first guide screen returns. If the setting on the first guide screen displayed on the touch panel display is good, the start key shown in FIG. 5 may be pressed.

The information designated on the operation panel 102 including the touch panel display 300 is sent to the overall control unit 533 via the display control unit shown in FIG. 13 and overall control is made.

In the case of copying, the information that is designated by the paper type icon 407 or automatically identified, and the information about the number of copies are sent from the display control unit 534 to the input output operation control unit 532 via the overall control unit 533. The information is further sent to the printer control unit 531 and control is made so that satisfactory printing is carried out in accordance with the paper type.

When each mode of LAN, PRN and FAX of the function mode selection keys 305 is selected, the function mode selection signal is transmitted from the display control unit 534 to the overall control unit 533 and transmitted to the machine status managing unit 535. Then, this multifunction color copier is set in a status suitable for the selected mode.

According to the above embodiment, a multifunction color copier can be provided in which, even if the user does not know the paper type of the recording paper at the time of printing and does not input the paper type, the paper type can be automatically identified easily and accurately and the printing time will not be increased as a whole.

In the multifunction color copier of the above embodiment, the paper type identification device is provided parallel to the operation panel 102, and when the paper type is to be automatically identified, a text for guiding insertion of the recording paper is displayed on the touch panel display included in the operation panel 102. Therefore, the user can easily insert the recording paper into the insertion port of the paper type identification device, and the paper type can be automatically identified.

However, in a case where the user can easily find the paper type identification device in this invention, a display to facilitate insertion of the recording paper into the paper type identification device need not necessarily be shown on the touch panel display, and the invention can also be applied to an image forming apparatus in which an operation panel having a touch panel display is not provided.

In the above embodiment, the case where the invention is applied to a multifunction color copier is described. However, the invention can be applied not only to a multifunction color copier but also to other image forming apparatuses that have an image forming unit to generate an image to be printed on a recording paper and that designate the paper type for printing, such as ordinary copy machines and facsimile.

Obviously, many modifications and variations of this invention are possible in the light of the above teachings. It is therefore to be understood that within the scope of the appended claims, this invention may be practiced otherwise than as specification.

What is claimed is:

1. An image forming apparatus comprising:

an image generating unit configured to generate an image to be printed on a recording paper;

a paper type designating unit configured for a user to directly designate a type of the recording paper or to designate automatic identification of a type of the recording paper;

a paper type identification device configured to identify the type of the recording paper presented by the user when automatic identification of the type of the recording paper is designated by the paper type designating unit, the paper type identification device comprises a casing having an insertion port to which the recording paper to have its paper type identified is inserted, and a paper type identifying unit provided in this casing and configured to identify the type of the inserted recording paper; and a printing unit configured to print the image generated by the image generating unit onto the recording paper in accordance with the type of the recording paper identified by the paper type identification device.

2. The image forming apparatus according to claim 1, wherein the paper type identification device further comprises a pair of pull-in ejection rollers provided in the casing and configured to pull the recording paper in to the paper type identifying unit, and to eject the recording paper after identification of the recording paper is carried out by the paper type identification device.

3. The image forming apparatus according to claim 2, wherein the paper type identification device further comprises an edge detection sensor provided at a position where the recording paper on which the identification is to be carried out has passed the paper type identification device, and configured to detect an edge of the recording paper, and a pull-in ejection control unit configured to stop rotation of the pull-in ejection rollers when the edge of the recording paper is detected by the edge detection sensor.

4. The image forming apparatus according to claim 3, wherein the paper type identifying device has a roller and measures thickness of the recording paper by a distance of vertical movement of the roller caused by the thickness of the paper, and thereby identifies the type of the recording paper.

5. The image forming apparatus according to claim 3, wherein the paper type identification device comprises a light emitting unit provided toward one side of the passing recording paper and configured to cast light, and a light receiving unit provided toward the other side of the passing recording paper and configured to receive transmitted light of the light cast from the light emitting unit.

6. An image forming apparatus comprising:

an image generating unit configured to generate an image to be printed on a recording paper;

a paper type designating unit configured for a user to directly designate a type of the recording paper or to designate automatic identification of a type of the recording paper;

a paper type identification device configured to identify the type of the recording paper presented by the user when automatic identification of the type of the recording paper is designated by the paper type designating unit, the paper type identification device comprising:

a casing having an insertion port to which the recording paper to have its paper type identified is inserted;

a paper type identifying unit provided in this casing and configured to identify the type of the recording paper;

a pull-in ejection roller configured to guide the recording paper to this paper type identifying unit and to eject the recording paper from the casing after identification of the paper type of the recording paper is finished by the paper type identifying unit;

an edge detection sensor provided at a position where the recording paper has passed the paper type identifying unit and configured to detect an edge of the recording paper; and a pull-in ejection control unit configured to drive the pull-in ejection roller in order to rotate the pull-in ejection roller forward to pull the recording paper in until the edge of the recording paper is detected by the edge detection sensor, and to rotate the pull-in ejection roller backward to eject the recording paper after the type of the pulled-in recording paper is identified by the paper type identifying unit; and a printing unit configured to print the image generated by the image generating unit onto the recording paper in accordance with the type of the recording paper identified by the paper type identification device.

7. An image forming apparatus comprising:

an image generating unit configured to generate an image to be printed on a recording paper;

a paper type designating unit configured for a user to designate a type of the recording paper or to designate automatic identification of a type of the recording paper;

a paper type identification device configured to identify the type of the recording paper presented by the user when automatic identification of the type of the recording paper is designated by the paper type designating unit;

a printing unit configured to print the image generated by the image generating unit onto the recording paper in accordance with the type of the recording paper identified by the paper type identification device; and an operation panel configured to display setting related to printing on the recording paper and to enable input of a change in the setting related to the printing, the paper type identification device comprises a casing having an insertion port to which the recording paper to have its paper type identified is inserted, and a paper type identifying unit provided in this casing and configured to identify the type of the inserted recording paper.

8. The image forming apparatus according to claim 7, wherein the operation panel has a ten-key pad that enables designation and input of the number of print sheets, and a touch panel display that can change a display as the user touches it.

9. The image forming apparatus according to claim 8, wherein the operation panel and the paper type identification device are provided parallel to each other, and when automatic identification of the type of the recording paper is selected in the paper type designating unit, it shows a display on the touch panel display of the operation panel that instructs insertion of the recording paper into the insertion port of the paper type identification device.

10. An image forming apparatus comprising:

an image generating unit configured to generate an image to be printed on a recording paper;

a paper type designating unit configured for a user to designate a type of the recording paper or to designate automatic identification of a type of the recording paper;

a paper type identification device configured to identify the type of the recording paper presented by the user when automatic identification of the type of the recording paper is designated by the paper type designating unit;

a printing unit configured to print the image generated by the image generating unit onto the recording paper in accordance with the type of the recording paper identified by the paper type identification device; and an operation panel configured to display setting related to printing on the recording paper and to enable input of a change in the setting related to the printing, the paper type identification device comprising:

a casing having an insertion port to which the recording paper to have its paper type identified is inserted;

a paper type identifying unit provided in this casing and configured to identify the type of the recording paper;

a pull-in ejection roller configured to guide the recording paper to this paper type identifying unit and to eject the recording paper from the casing after identification of the paper type of the recording paper is finished by the paper type identifying unit;

an edge detection sensor provided at a position where the recording paper has passed the paper type identifying unit and configured to detect an edge of the recording paper; and a pull-in ejection control unit configured to drive the pull-in ejection roller in order to rotate the pull-in ejection roller forward to pull the recording paper in until the edge of the recording paper is detected by the edge detection sensor, and to rotate the pull-in ejection roller backward to eject the recording paper after the type of the pulled-in recording paper is identified by the paper type identifying unit.

11. The image forming apparatus according to claim 10, wherein the operation panel and the paper type identification device are provided parallel to each other, and when automatic identification of the type of the recording paper is selected in the paper type designating unit, it shows a display on the operation panel that instructs insertion of the recording paper into the insertion port.

12. A paper type identification method for an image forming apparatus, the apparatus comprising an image generating unit configured to generate an image to be printed on a recording paper, a paper type designating unit configured for a user to directly designate a type of the recording paper or to designate automatic identification of a type of the recording paper, and a printing unit configured to print the image generated by the image generating unit onto the recording paper in accordance with a type of the recording paper identified by a paper type identification device, the method comprising:

rotating a pair of pull-in ejection rollers forward to pull the recording paper into the paper type identification device when automatic identification of the type of the recording paper is designated by the paper type designating unit;

identifying the type of this recording paper by the paper type identification device; and rotating the pull-in ejection rollers backward to eject the recording paper from the paper type identification device after this identification is finished.

13. A paper type identification method for an image forming apparatus, the apparatus comprising an image generating unit configured to generate an image to be printed on a recording paper, a paper type designating unit configured for a user to directly designate a type of the recording paper or to designate automatic identification of a type of the recording paper, a printing unit configured to print the image generated by the image generating unit onto the recording paper in accordance with a type of the recording paper identified by a paper type identification device, and an operation panel having a touch panel display configured to display setting related to printing on the recording paper and to enable input of a change in the setting related to the printing, the method comprising:

showing, on the touch panel display, a display to instruct insertion of the recording paper into an insertion port of the paper type identification device, when automatic identification of the type of the recording paper by the paper type designating unit is designated on the touch panel display;

rotating a pair of pull-in ejection rollers forward to pull the recording paper in when the recording paper is inserted in the insertion port;

identifying the type of this recording paper by the paper type identification device; and rotating the pull-in ejection rollers backward to eject the recording paper from the paper type identification device after this identification is finished.

* * * * *